US011786432B2

(12) United States Patent
Willimon et al.

(10) Patent No.: US 11,786,432 B2
(45) Date of Patent: Oct. 17, 2023

(54) GROIN PROTECTION APPARATUS, SYSTEMS AND METHODS

(71) Applicants: Smith & Nephew, Inc., Memphis, TN (US); Samuel Clifton Willimon, Atlanta, GA (US)

(72) Inventors: Samuel Clifton Willimon, Atlanta, GA (US); Richard Lunn, Kingston, MA (US); Timothy Young, Natick, MA (US)

(73) Assignee: SMITH & NEPHEW, INC., Memphis, TN (US)

( * ) Notice: Subject to any disclaimer, the term of this patent is extended or adjusted under 35 U.S.C. 154(b) by 547 days.

(21) Appl. No.: 16/090,926

(22) PCT Filed: Apr. 3, 2017

(86) PCT No.: PCT/US2017/025796
§ 371 (c)(1),
(2) Date: Oct. 3, 2018

(87) PCT Pub. No.: WO2017/176655
PCT Pub. Date: Oct. 12, 2017

(65) Prior Publication Data

US 2019/0105213 A1 Apr. 11, 2019

Related U.S. Application Data

(60) Provisional application No. 62/400,884, filed on Sep. 28, 2016, provisional application No. 62/318,533, filed on Apr. 5, 2016.

(51) Int. Cl.
*A61G 13/12* (2006.01)

(52) U.S. Cl.
CPC ..... *A61G 13/123* (2013.01)

(58) Field of Classification Search
CPC ..... A63B 69/0059; A63B 69/0062; A63B 21/4011; A63B 2023/04;
(Continued)

(56) References Cited

U.S. PATENT DOCUMENTS 2,915,760 A * 12/1959 Bair ..... A61F 2/605 623/27
4,135,504 A * 1/1979 Spann ..... A61F 5/0193 602/24

(Continued)

OTHER PUBLICATIONS

Merriam-Webster, "wing," https://www.merriam-webster.com/dictionary/wing.*

*Primary Examiner* — Victoria Hicks Fisher
(74) *Attorney, Agent, or Firm* — Burns & Levinson, LLP; Joseph M. Maraia

(57) ABSTRACT

Disclosed herein are apparatus, systems and methods for protecting a patient's groin area and better redistributing forces while distracting the patient's hip. These generally involve anatomically correct protective pad and/or a winged protective cup which be used in conjunction with one another or independently. The anatomically correct protective pad may include a groin-facing portion including a recess for housing/protecting a patient's genital region. The pad may further include opposing thigh-facing portions configured to align with the inner thighs of the and better distribute forces (e.g., distraction forces) away from the groin region and longitudinally across a surface area of the inner thighs. The winged protective cup may include a saddle or winged configuration including opposing wings extending from a cup portion and also configured to distribute forces away from the groin region and longitudinally across a surface area of the inner thighs.

17 Claims, 10 Drawing Sheets

(58) Field of Classification Search
CPC ..... A63B 2023/0411; A63B 71/1216; A63B 23/04; A61G 13/12; A61G 13/1205; A61G 13/123; A61G 13/126; A61G 13/0036; A61G 13/0063; A61G 13/0081; A61G 5/1043; A61G 5/1091; A47C 16/00; A47C 7/185; A47G 9/10; A47G 9/1063; A47G 9/109; A61F 5/37; A61F 5/3769; A61F 5/3715; A61F 5/0193; A61F 5/3753; A61F 5/04; A61F 5/042; A61F 5/048; A41D 13/05; A41D 13/0525; A41D 13/0506
See application file for complete search history.

(56) References Cited

U.S. PATENT DOCUMENTS 4,372,299 A * 2/1983 Fixel ..... A61F 5/0193 5/648
4,433,678 A * 2/1984 Spann ..... A61F 5/0193 128/876
6,058,514 A * 5/2000 Hart ..... A41B 9/001 2/408
6,182,314 B1 * 2/2001 Frydman ..... A47C 20/021 128/845
8,156,941 B1 * 4/2012 Simms ..... A61F 5/37 128/882
8,814,760 B2 * 8/2014 Hyacinth ..... A63B 69/0059 482/92
D743,557 S * 11/2015 Pichette ..... D24/184
2004/0260299 A1 * 12/2004 Fu Kong ..... A61G 13/0081 606/86 R
2008/0262404 A1 * 10/2008 McKenzie ..... A61F 5/40 602/70
2009/0229056 A1 * 9/2009 Edinger ..... A47C 20/021 5/648
2013/0091625 A1 * 4/2013 Aziz ..... A41D 13/05 2/466
2013/0199541 A1 * 8/2013 Sluss ..... A61G 7/00 128/845
2018/0280222 A1 * 10/2018 Pichette ..... A61G 13/0081

* cited by examiner

GROIN PROTECTION APPARATUS, SYSTEMS AND METHODS

CROSS-REFERENCE TO RELATED APPLICATIONS

This application is the U.S. national phase entry under 35 U.S.C. § 371 of International Application No. PCT/US2017/025796, filed Apr. 3, 2017, entitled GROIN PROTECTION APPARATUS, SYSTEMS AND METHODS, which in turn claims priority to and benefit of U.S. Provisional Application No. 62/400,884, filed Sep. 28, 2016 and U.S. Provisional Application No. 62/318,533, filed Apr. 5, 2016, the contents of which are incorporated herein by reference in their entirety for all purposes.

BACKGROUND

The present disclosure relates to hip arthroscopy and other hip related surgical procedures involving hip distraction. More particular, the present disclosure relates to apparatus, systems and methods for provided improved patient protection during hip distraction.

Hip arthroscopy procedures require a patient's femoral head to be extracted from the acetabular socket making up the hip joint. The reason for this is a lack of initial working space in the joint for arthroscopic surgery. Conventionally, extraction is obtained by setting the patient on an operating table with a perineal post (10) in between their legs. See, e.g., FIG. 1A.

As depicted in FIG. 1B, a traction force of 30-80 lbs is applied to the leg in order to distract the hip joint. A reaction force to the traction force is applied by the perineal post (10) onto the patient's groin/inner thigh area. Traction can be applied anywhere from 45 minutes to approximately two hours. Such a high amount of force for an extended period of time can result in neuropraxia, which is nerve damage to the affected area (specifically the pudendal nerve). In addition, there can be damage to the male and female anatomy.

The apparatus, systems and methods of the present disclosure advantageously address the deficiencies of a conventional perineal post.

SUMMARY

Disclosed herein are exemplary embodiments of apparatus, systems and methods for protecting a patient's groin area while distracting the patient's hip.

In example embodiments a protective pad (e.g., for protecting a patient's groin area while distracting the patient's hip) may include a unitary body defining a receiving member adapted to mate with a perineal post of a distraction table. Advantageously, the unitary body may have one or more perimeter surfaces extending between a base region and a top region thereof. These one or more perimeter surfaces may define each of: (i) opposing thigh-facing portions having flat or contoured areas that, in use, are configured to align with the patient's inner thighs and (ii) a groin-facing portion extending between the opposing thigh-facing portions the groin-facing portion including a first recess that, in use, is configured to fit over a genital region of the patient. Advantageously, the receiving member of the protective pad may configured to mate with the peritoneal post via an engaging portion on the peritoneal post.

In example embodiments, the opposing thigh-facing portions of the protective pad may be conformable relative to a shape of the patient's inner thighs. For example, in some embodiments, the pad may be semi-flexible so as to conform. Alternatively the opposing thigh-facing portions may be shaped/configured to match a geometry of the patient's inner thighs. Thus, in some embodiments, the flat or contoured areas may be contoured differently than adjacent portions of the one or more perimeter surfaces. For example, the flat or contoured areas may define horizontally elongated grooves on opposite sides of the unitary body, e.g., which include concave regions that, in use, are configured for conforming with a tubular shape of the patients' inner thighs. Alternatively, the flat or contoured areas define planer regions. In general, the flat or contoured areas may be parallel to one another, although in some embodiments, the flat or contoured areas may be angled in toward the groin to provide a more natural fit. In some embodiments, to the thigh-facing portions may define different flat or contoured areas for use depending on a rotational orientation of the pad (e.g., where the pad is rotated to select between different recesses).

In general, the groin-facing portion of the protective pad may be conformable relative to a shape of the patient's groin anatomy. For example, in some embodiments, the pad may be semi-flexible so as to conform. Alternatively the groin-facing portion may be shaped/configured to match a geometry of the patient's groin. In example embodiments, the first recess may be a vertically elongated groove which, toward the top region of the unitary body, tapers away from the genital region so as to allow for visualization of the genital region. Notably, in some embodiments, the entire unitary body may from the base region to the top region, so as to allow for visualization of the genital region and/or to provide enhanced surgical access.

In example embodiments, the one or more perimeter surfaces may further define a second recess on a side of the unitary body opposite from the first recess. This second recess may be dimensioned differently than the first recess so as to enable fitting over a smaller or larger genital region than the first recess, during use thereof. This may be advantageous for properly configuring the device for the patient. For example, in some embodiments, the first (larger) recess may configured for use with a male patient while the second (smaller) recess may be configured for use with a female patient.

In example embodiments, the one or more perimeter surfaces may further define arcuate transition regions between the recess of the groin-facing portion and the flat or contoured areas of the opposing thigh-facing portions. These transition regions may advantageously enable improved distribution of forces and added comfort.

In further example embodiments, the pad may include a strap (or straps) configured for binding the patient's legs relative to the pad. Notably, the strap may be integral or separate from the pad.

In example embodiments, the pad may be used in a method for protecting a patient's groin area (e.g., while distracting the patient's hip). This method may advantageously entail (i) securing the pad relative to the perineal post of the distraction table; and (ii) positioning the patient such that the pad is between the patient's legs adjacent the genital region and the patient's inner thighs are aligned with the flat or contoured areas of the opposing thigh-facing portions. The pad advantageously will provide for distribution of distraction forces away from the groin as well as additional comfort and protection. In example embodiments, the method may further include selecting the groin-facing portion from a pair possible groin-facing portions on opposite sides of the pad each possible groin-facing portion the pad each including a differently dimensioned recess. This may be done, e.g., to differentiate between male and female patients.

In example embodiments, a method is provided for utilizing the pad to secure a patient's legs following a surgical procedure. This method may include (i) positioning the pad between the patient's legs adjacent the feet such that the legs are aligned with the flat or contoured areas of the opposing thigh-facing portions and (ii) utilizing a strap to bind the patient's legs relative to the pad.

In example embodiments, a method is provided for utilizing the pad to provide stability to the operative leg following a surgical procedure. This method may include placing the pad flat-side down against the gurney or bed, and securing the foot of the operative leg into one of the recesses (which was used during surgery to provide genital clearance). Securing the foot in this manner would allow the operative leg to be held in a stable position without requiring that the non-operative leg be secured as well.

In example embodiments, the pad may be utilized in a system which may further include a protective cup. The protective cup may advantageously include (i) a housing that, in use, is configured to fit over the genital region of the patient, the housing having a perimeter, and (ii) a pair of opposing wings extending from opposite sides of the perimeter of the housing that, in use, are configured to extend from the patient's groin to the patient's inner thighs. Notably, the recess of the pad may be configured to fit over the housing of the protective cup thereby also fitting over the genital region of the patient.

In example embodiments, each of the wings may define an arcuate region that, in use, is configured to extend between the patient's groin and one of the patient's inner thighs. The arcuate region may advantageously be configured to be conformable relative to an anatomical transition between the patient's groin and the patient's inner thighs. In further embodiments, the arcuate region may be configured to enable redistribution of forces from the patient's groin to the patient's inner thighs. In some of the embodiments, each of the wings may also define a concave region that, in use, is configured for conforming with a tubular shape of the patients' inner thighs, Note that the housing is typically more rigid than the wings so as to provide greater protection with respect to the genitals.

The system of the pad and cup may be used in conjunction with one another in a method for protecting a patient's groin area (e.g., while distracting the patient's hip). This method may entail (i) securing the pad relative to the perineal post of the distraction table; (iii) fitting the patient with the protective cup such that the patients genital region is protected by the housing and the wings are aligned with the patient's inner thighs; and (iii) positioning the patient such that the pad is between the patient's legs adjacent the protective cup and the patient's inner thighs are aligned with the flat or contoured areas of the opposing thigh-facing portions. Note that in further embodiments, the protective cup may be used separately from the pad or with a generic type of pad.

In example embodiments, the system for protecting a patient's groin area while distracting the patient's hip, includes a protective pad. The protective pad has a unitary body defining a receiving member adapted to mate with a perineal post of a distraction table, the unitary body having one or more perimeter surfaces extending between a base region and a top region thereof. The one or more perimeter surfaces define: opposing thigh-facing portions having flat or contoured areas that, in use, are configured to align with the patient's inner thighs, the flat or contoured areas being generally parallel to one another, and, in use, are adapted to be generally parallel to a sagittal plane of the patient; and a groin-facing portion extending between the opposing thigh-facing portions, the groin-facing portion including a first recess that, in use, is configured to fit over a genital region of the patient. The system also includes a protective cup including: a housing that, in use, is configured to fit over the genital region of the patient, the housing having a perimeter; and a pair of opposing wings extending from opposite sides of the perimeter of the housing that, in use, are configured to define a saddle-shaped transition extending from the patient's groin to the patient's inner thighs. The first recess of the protective pad is configured to fit over the housing of the protective cup thereby also fitting over the genital region of the patient. Each wing of the pair of opposing wings defines an arcuate region adapted to transition between the groin and the inner thigh region of the patient, that, in use, is configured to extend a length of the patient's inner thigh from the patient's groin. The pair of opposing wings are a semi-flexible material, flexing of the pair of opposing wings redistributing forces from the patient's groin along the length of the patient's inner thigh through the pair of opposing wings of the protective cup. The arcuate region is configured to be conformable relative to an anatomical transition between the patient's groin and the patient's inner thighs.

BRIEF DESCRIPTION OF FIGURES

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments of the present disclosure.

DETAILED DESCRIPTION

Figure 1A:
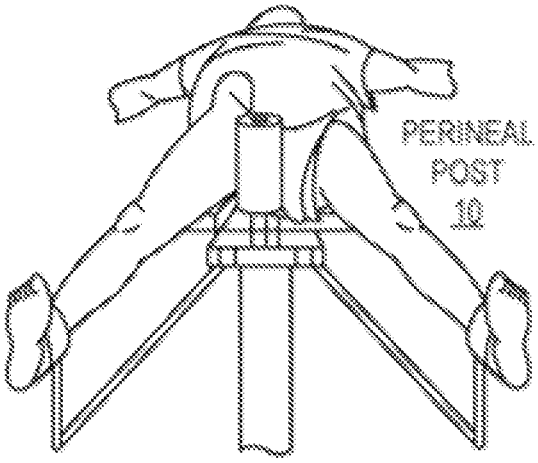
FIGS. 1A and 1B depicts a conventional system for hip distraction and the resulting forces of using such a system, according to the present disclosure.
Figure 1B:
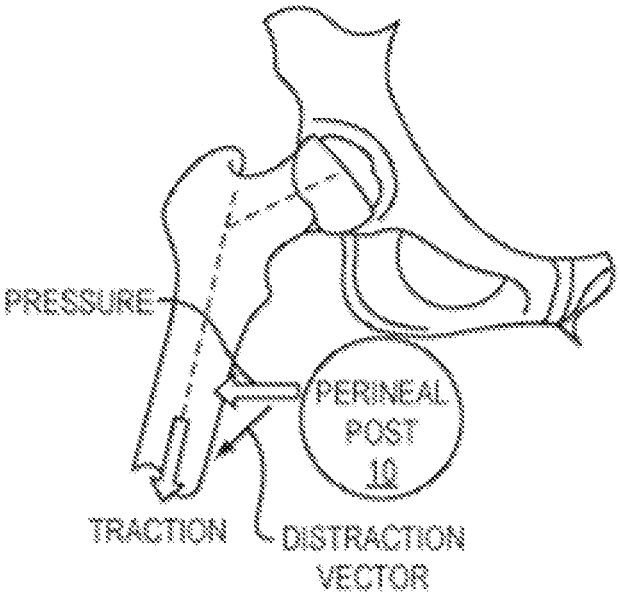

Apparatus, systems and methods are provided herein for enabling improved patient protection during hip distraction. In example embodiments, an anatomically correct pad for a perineal post of an operating table is disclosed. In further example embodiments, a winged or saddle-shaped protective cup is disclosed. The pad and protective cup may be used together as a system or independently.

The anatomically correct pad disclosed herein, may define a groin-facing portion, e.g., configured to generally, align with a transverse plane of a patient. Advantageously, in some embodiments, the pad may include a recess in the groin-facing portion thereof, e.g., defined medially, e.g., with respect to a midsagittal plane of the patient. The recess may be generally "U" shaped (e.g., as defined in a coronal plane of the patient) or otherwise configured to fit over a genital region of a patient (in particular, of a male patient). It will be appreciated that other geometries may also be utilized for the recess, including, e.g., a spherical cap or elliptical cap shaped geometry or other geometry. In some embodiments the recess, may be symmetrically defined, e.g., with respect to the midsagittal plane of the patient and/or with respect to a midcoronal plane of the patient. In some embodiments, the recess may be configured to taper away from the genital region, toward a top region of the pad, so as to allow for improved visualization of the genital region during surgery.

In example embodiments, the pad may define a plurality of possible groin-facing portions, each including a differently dimensioned recess. Thus, in some embodiments, the pad may include pair of possible groin-facing portions on opposite sides of the pad; one including a first recess dimensioned and configured for a male patient and the other including a second recess dimensioned and configured for a female patient. During use, the pad may simply be rotated so that the appropriate recess is facing the groin.

In example embodiments, the lateral geometry of the groin-facing portion may also be configured to better conform anatomically with a patient, e.g., with respect to the transition from the groin to a superior portion of the inner thigh. Thus, in some embodiments, the lateral geometry of the groin-facing portion may define a transition geometry, e.g., between transverse and sagittal planes of the patient. In example embodiments, the transition geometry may be characterized by a curvature with respect to a coronal plane of the patient, e.g., defining a convex surface configured to generally conform with the geometry the lateral groin and/or a superior portion of the inner thigh.

Advantageously, in some embodiments, the recess may be configured to fit over and/or receive a convex portion of a protective genital cup used in conjunction with the pad. In example embodiments, the recess may be larger (e.g., deeper with respect to the superior-inferior axis of the patient, and/or wider with respect to the anteroposterior and mediolateral axes of the patient) than the dimensions of the cup, thereby providing a margin between the pad and cup during use thereof. In this manner, the genital region may be insulated and distraction forces may be largely isolated from the genital region and distributed across other portions of the hip and/or groin. In other embodiments, the recess may be configured to substantially match the shape and/or size of the convex portion of genital cup. In such embodiments, the cup may be configured to redistribute and forces (for example, any distraction forces) which are transferred from the pad to the cup away from the genital region (and across other portions of the hip and/or groin).

In example embodiments, the pad may further include opposing thigh-facing portions which are configured (e.g. shaped) to align with the inner thighs. In particular, the opposing thigh-facing portions may each define an elongated contact surface configured to distribute forces (e.g., distraction forces) longitudinally (e.g., extending between proximal and distal regions of the thigh). In example embodiments, the elongated contact surfaces may be planer surfaces. In some embodiments, the planer surfaces for the opposing thigh-facing portions may be parallel to one another, for example, extending parallel to a sagittal plane of the patient. In other embodiments, one or both of the opposing thigh facing portions may be angled laterally with respect to a sagittal plane of the patient.

In general, the groin-facing portion of the bad may be conformable, e.g. deformable, relative to an anatomic shape of the patients groin region. Similarly, the opposing thigh-facing portions of the pad may be conformable, e.g., deformable, relative to an anatomic shape of the patients inner thighs. Thus, in example embodiments, the pad may be constructed of a resiliently deformable material, for example, a memory foam material such as a polyurethane based memory foam material. In example embodiments select regions of the pad, for example, peripheral regions such as the groin-facing portion and/or thigh-facing portions, may be more easily deformable than other regions of the pad. Moreover, in exemplary embodiments, the pad may be constructed of a material which may promote breathability and/or prevent/mitigate irritation of the dermis. The pad may advantageously be constructed as a unitary body, for example a unitary u-shaped body.

In example embodiments, the pad may further include a receiving member adapted to mate with a perineal post of a distraction table. The receiving member may, for example, be defined as an aperture, channel or cavity extending through the pad, for example, through a central or medial portion of the pad, between top and bottom surfaces of the pad and along a sagittal axis. It is noted, however, that any conventional mechanism/configuration for mating the pad with a perineal post of a distraction table may be utilized.

Also disclosed herein, is a winged or saddle-shaped protective cup which may be used, e.g., in conjunction with the pad disclosed herein. The protective cup may generally include a genital cup portion configured to fit over and protect a patient's genital region and a pair of downward sloping wings on either side of the cup portion.

The genital cup portion may generally be constructed from a hard plastic or other rigid material and may define a cavity configured to comfortably receive a patient's genitals. In example embodiments, the cavity may include a tapered dorsal geometry and a bulbous ventral geometry, e.g., when viewed in a transverse plane. The bulbous geometry may be configured for receiving a patient's penis. In further example embodiments, the cavity may define a pair of lateral lobes between the tapered dorsal geometry and the bulbous ventral geometry configured for receiving a patient's testes. Notably, however, any conventional configuration of a protective genital cup may be utilized. In example embodiments, one or more portions of the genital cup, e.g., a rim of the genital cup may be lined with a soft or gel like material to add comfort for the patient.

The wings of the protective cup may be configured to define a curved/saddle-shaped transition between the groin and the inner thigh regions of a patient. Thus, wings may advantageously be configured to redistribute forces from the groin region to along the patient's inner thighs. In this way forces may be applied over a larger surface area of the thighs resulting in less pressure and higher patient comfort. In example embodiments, the wings may be formed of a semi-flexible polymer or other semi-flexible material and may be padded for patient comfort. Advantageously, in some embodiments, the wings may include a concave shape conforming to the tubular like curvature of a patients' inner thighs.

Notably, in some embodiments, padding rigidity/hardness along the protective cup or along the anatomically correct pad can vary from very soft to somewhat hard over the geometry thereof. Thus, for example, the padding may be adapted (e.g., harder padding) to provide for a structural transfer of forces or increased protection with respect to certain anatomical regions, e.g., sensitive anatomical regions such as proximal to the groin while allowing for increased comfort (e.g., softer padding) at other regions, e.g., proximal to the inner thigh hip junction, along the length of the inner thighs etc.

Advantageously the protective cup may be configured to mate with the anatomically correct pad disclosed herein. For example, as noted above a recess of a groin-facing portion of the pad may be configured to fit over and/or receive a convex geometry of a genital cup portion of the protective cup. Thigh facing portions of the pad may then be configured to align with the wings of the cup, e.g., when flexed. Thus, forces may be redistributed via the combination of the pad and cup.

Figure 2:
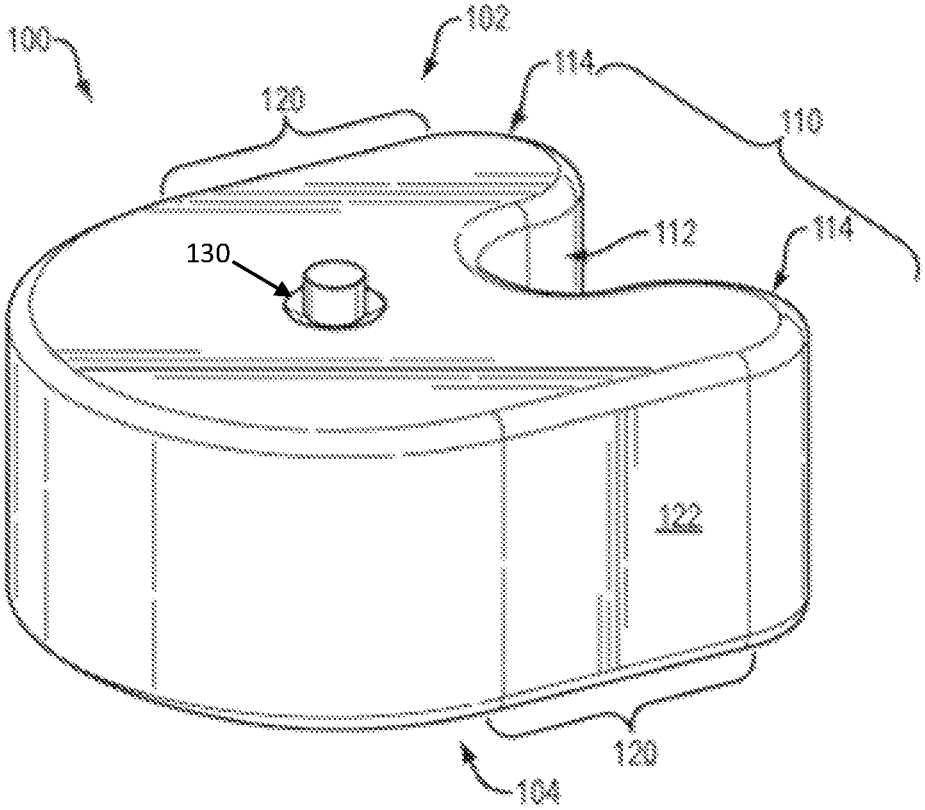
FIG. 2 depicts a perspective view of an exemplary anatomically correct pad, according to the present disclosure.

With initial reference to FIG. 2, an exemplary anatomically correct pad 100 is depicted. The pad 100 advantageously defines a groin-facing portion 110 which is configured to generally, align with a transverse plane of a patient. The groin-facing portion 110 includes a recess 112 defined medially, e.g., with respect to a midsagittal plane of the patient. In the depicted embodiment, the recess 112 is generally "U" shaped (as defined in a coronal plane of the patient). It will be appreciated, however, that other geometries may also be utilized for the recess, including, e.g., a spherical cap or elliptical cap shaped geometry or other geometry.

As depicted, the lateral geometry 114 of the groin-facing portion 110 may also be configured to better conform anatomically with respect to a patient, e.g., with respect to the transition from the groin to a superior portion of the inner thigh. Thus, the lateral geometry 114 of the groin-facing portion 110 defines a transition geometry between transverse and sagittal planes of the patient. As characterized by a curvature with respect to a coronal plane of the patient defining a convex surface configured to generally conform with the geometry the lateral groin and/or a superior portion of the inner thigh.

With reference still to FIG. 2, the pad 100 further includes opposing thigh-facing portions 120 which are configured (e.g. shaped) to align with the inner thighs of a patient. In particular, the opposing thigh-facing portions 120 may each define an elongated contact surface 122 configured to distribute forces (e.g., distraction forces) longitudinally (e.g., extending between proximal and distal regions of the thigh). In the depicted embodiment, the elongated contact surfaces 122 are parallel planer surfaces which extend parallel to a sagittal plane of the patient. The pad 100 further includes a receiving member 130 adapted to mate with a perineal post of a distraction table. As depicted, the receiving member 130 extends through a central or medial portion of the pad 100 between top 102 and bottom 104 surfaces of the pad and along a sagittal axis.

Figure 3A:
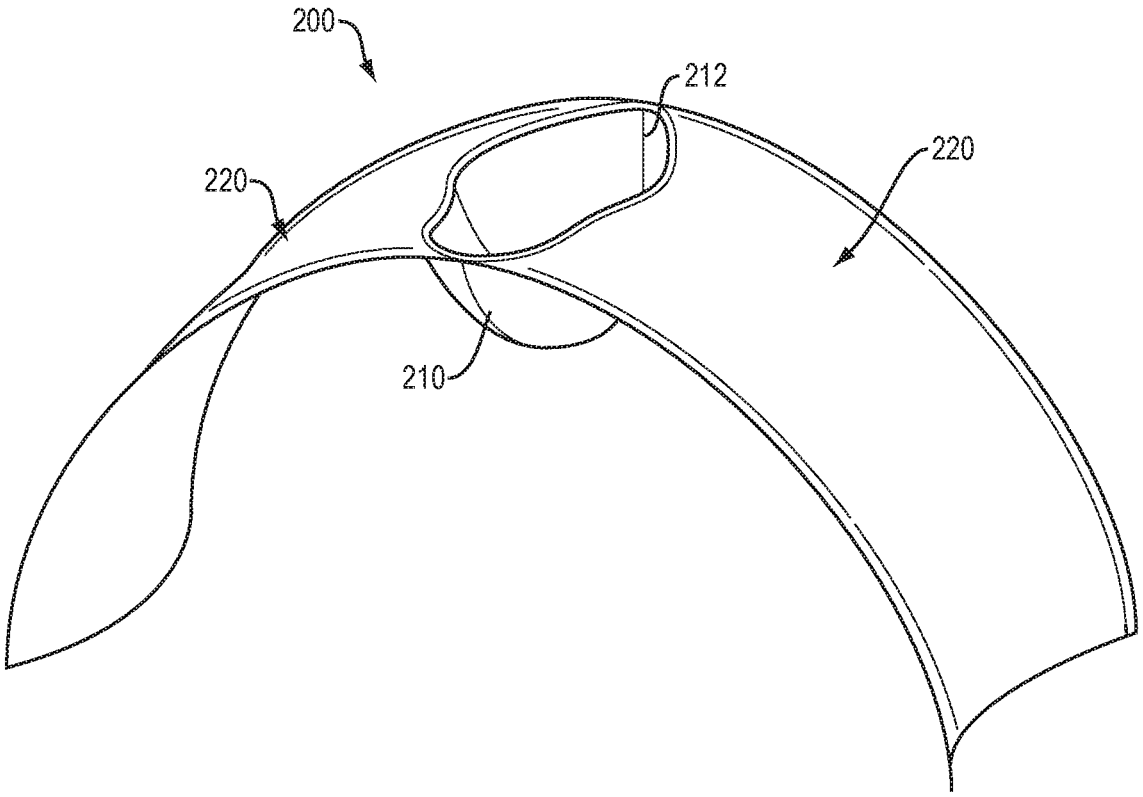
FIGS. 3A-C depict perspective, top and front views of an exemplary winged or saddle-shaped protective cup, according to the present disclosure.
Figure 3B:
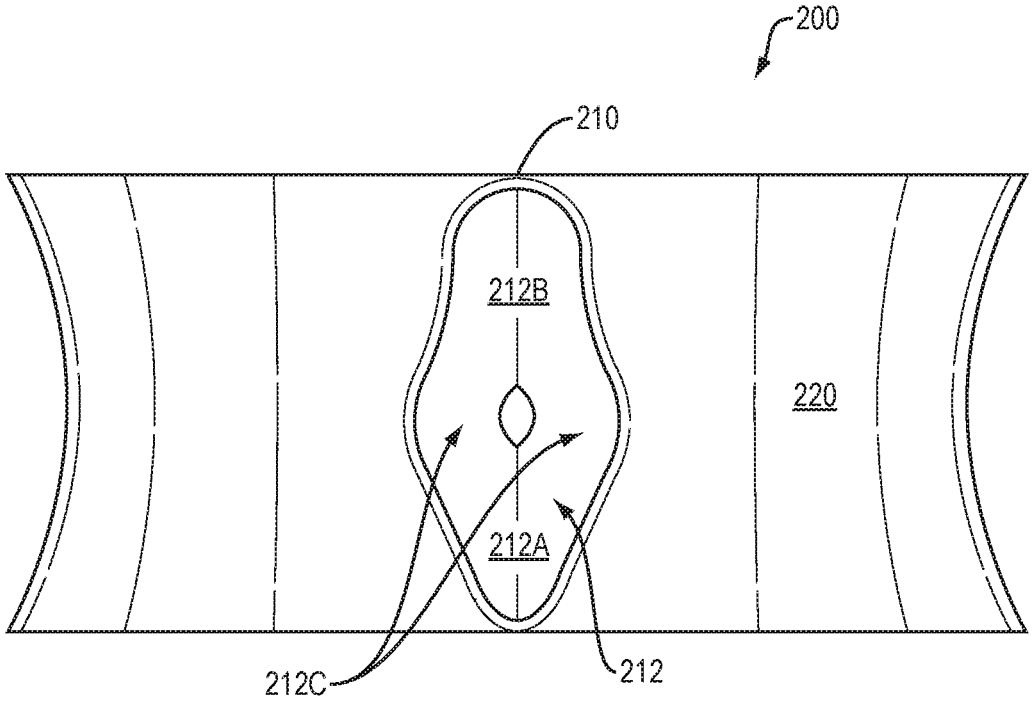
Figure 3C:
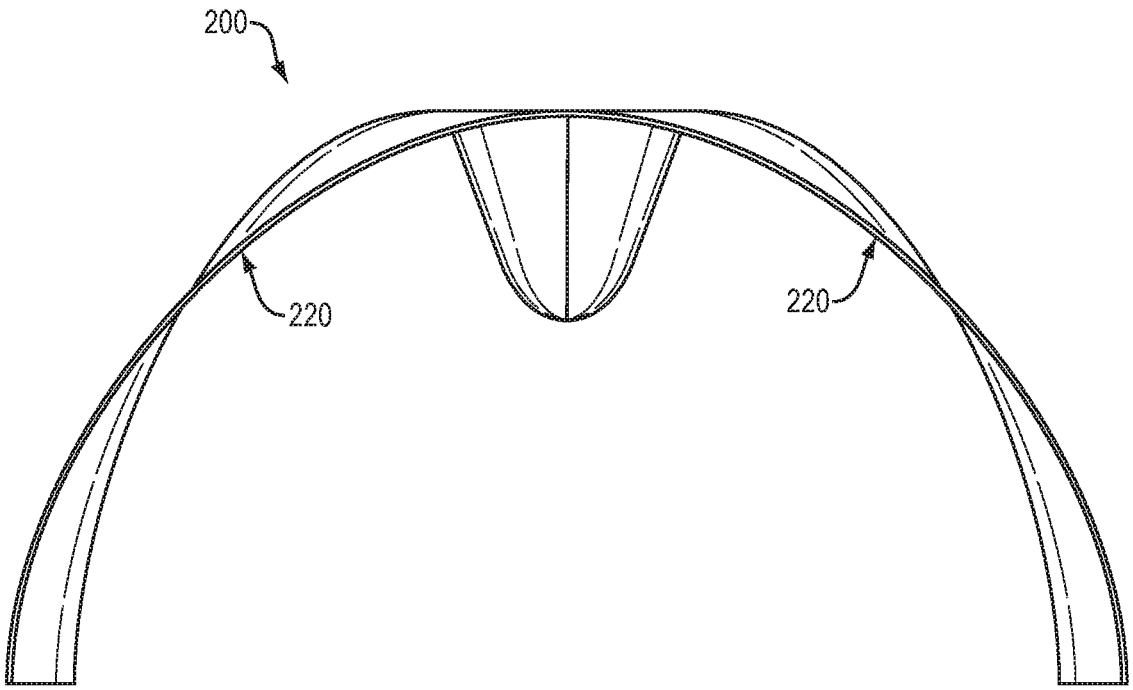

With reference now to FIGS. 3A-C, an exemplary winged or saddle-shaped protective cup 200 is depicted. The protective cup 200 includes a genital cup portion 210 configured to fit over and protect a patient's genital region and a pair of downward sloping wings 220 on either side of the cup portion. The genital cup portion 210 defines a cavity 212 configured to comfortably receive a patient's genitals. As depicted, the cavity includes a tapered dorsal geometry 212A and a bulbous ventral geometry 212B when viewed in a transverse plane. The cavity 212 further defines a pair of lateral lobes 212C between the tapered dorsal geometry 212A and the bulbous ventral geometry 212B. The bulbous geometry 212A is configured for receiving a patient's penis while the lateral lobes 212C are configured for receiving a patient's testes.

With reference still to FIGS. 3A-C, the wings 220 of the protective cup 200 are configured to define a curved/saddle-shaped transition between the groin and the inner thigh regions of a patient. In this manner, the wings 220 are configured to redistribute forces from the groin region to along the patient's inner thighs thereby applying the forces over a larger surface area resulting in less pressure and higher patient comfort. As depicted, the wings 220, include a concave shape conforming to the tubular like curvature of a patients' inner thighs.

Figure 4A:
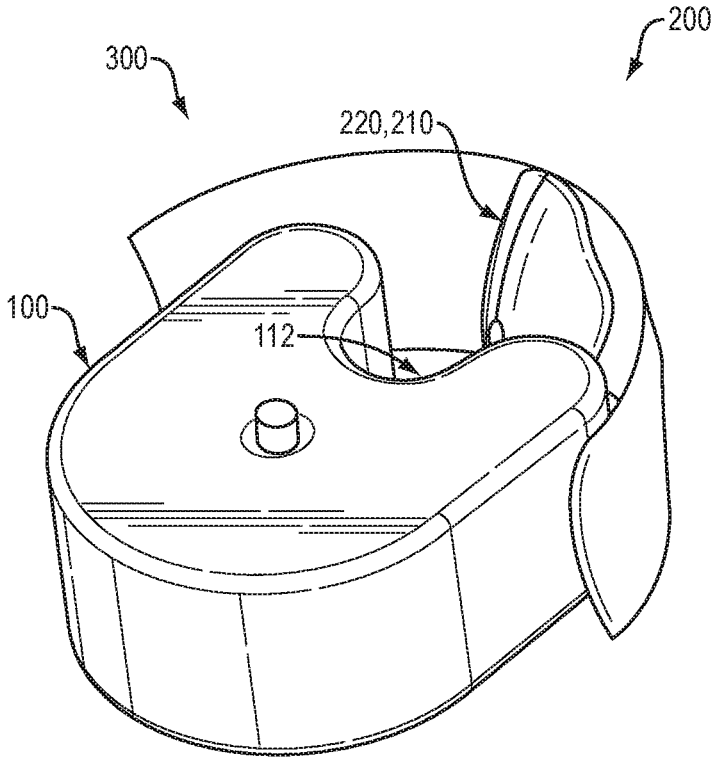
FIGS. 4A-B depict differing perspective views of the anatomically correct pad of FIG. 2 mating with the exemplary winged or saddle-shaped protective cup of FIGS. 3A-C, according to the present disclosure.
Figure 4B:
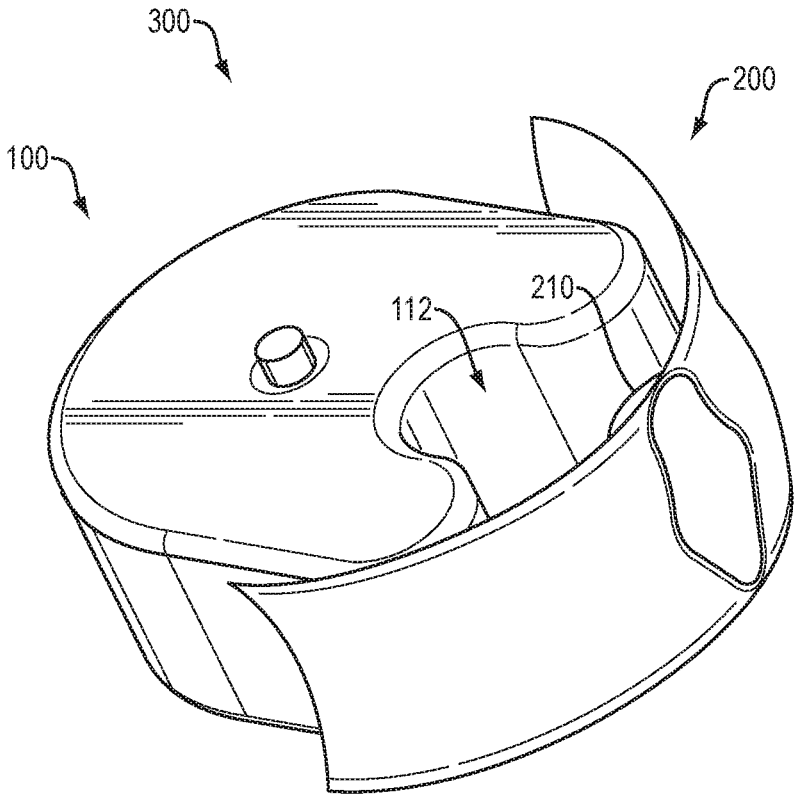
Figure 5A:
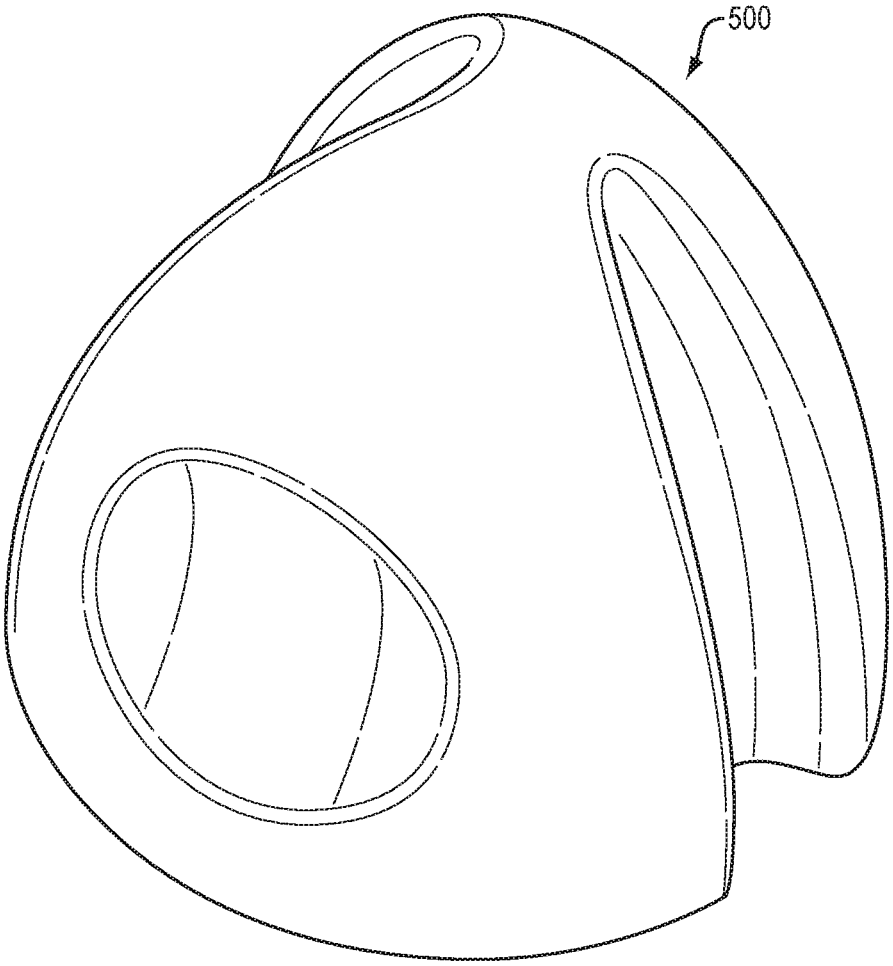
FIGS. 5A-E depict (i) top perspective, (ii) back, (iii) front, (iv) top and (v) bottom perspective views of a further example embodiment of an exemplary anatomically correct pad, according to the present disclosure.
Figure 5B:
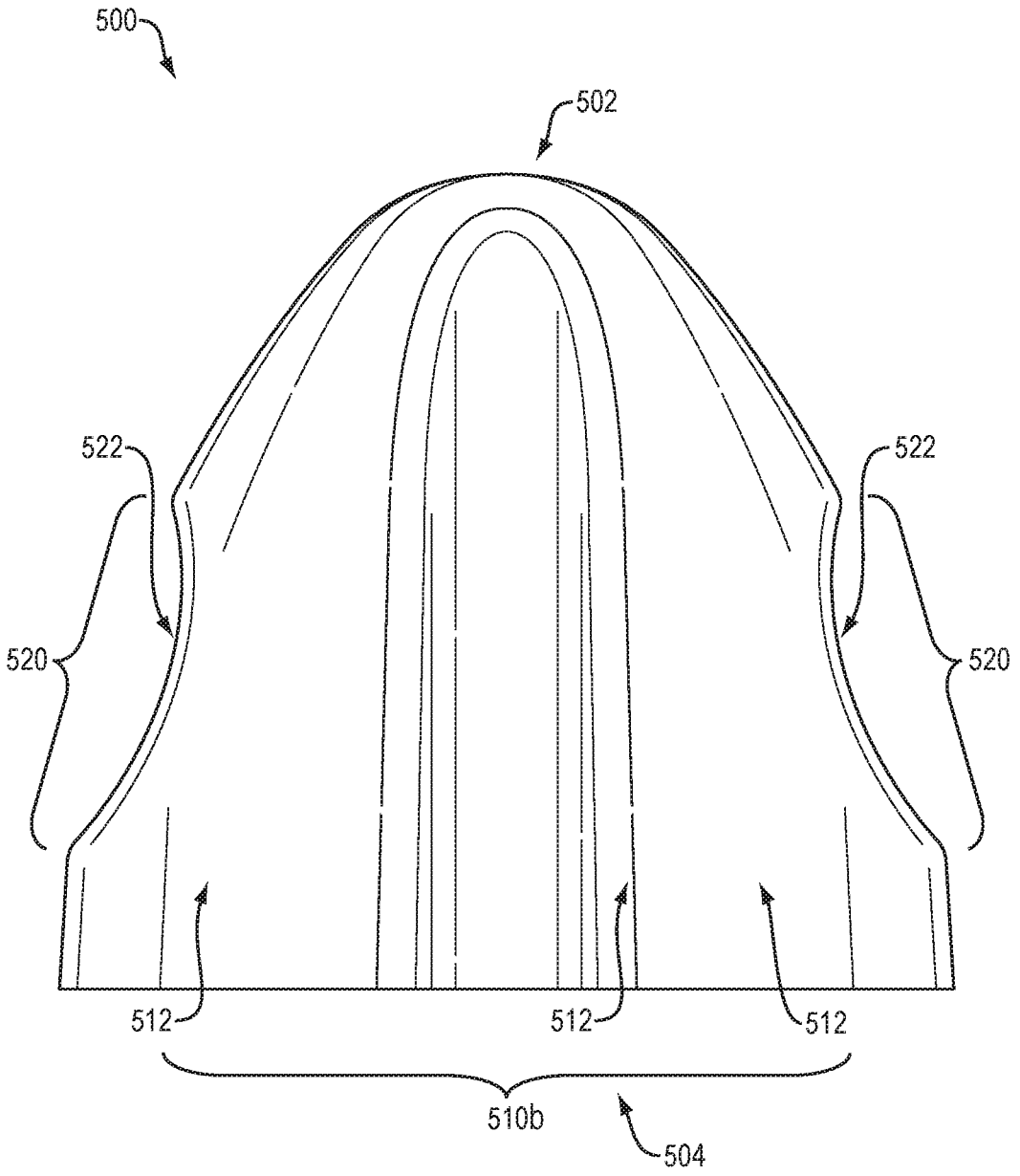
Figure 5C:
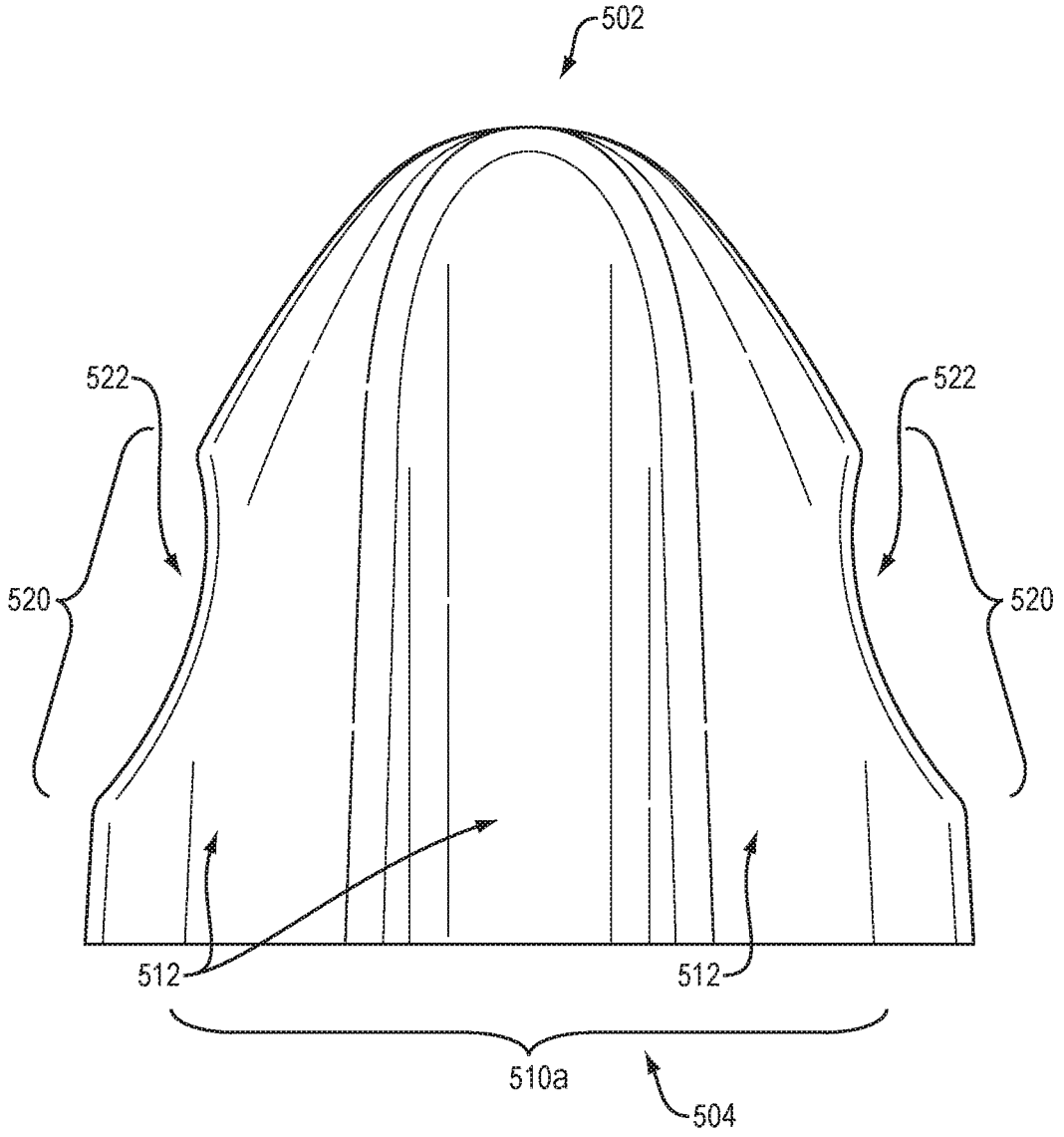
Figure 5D:
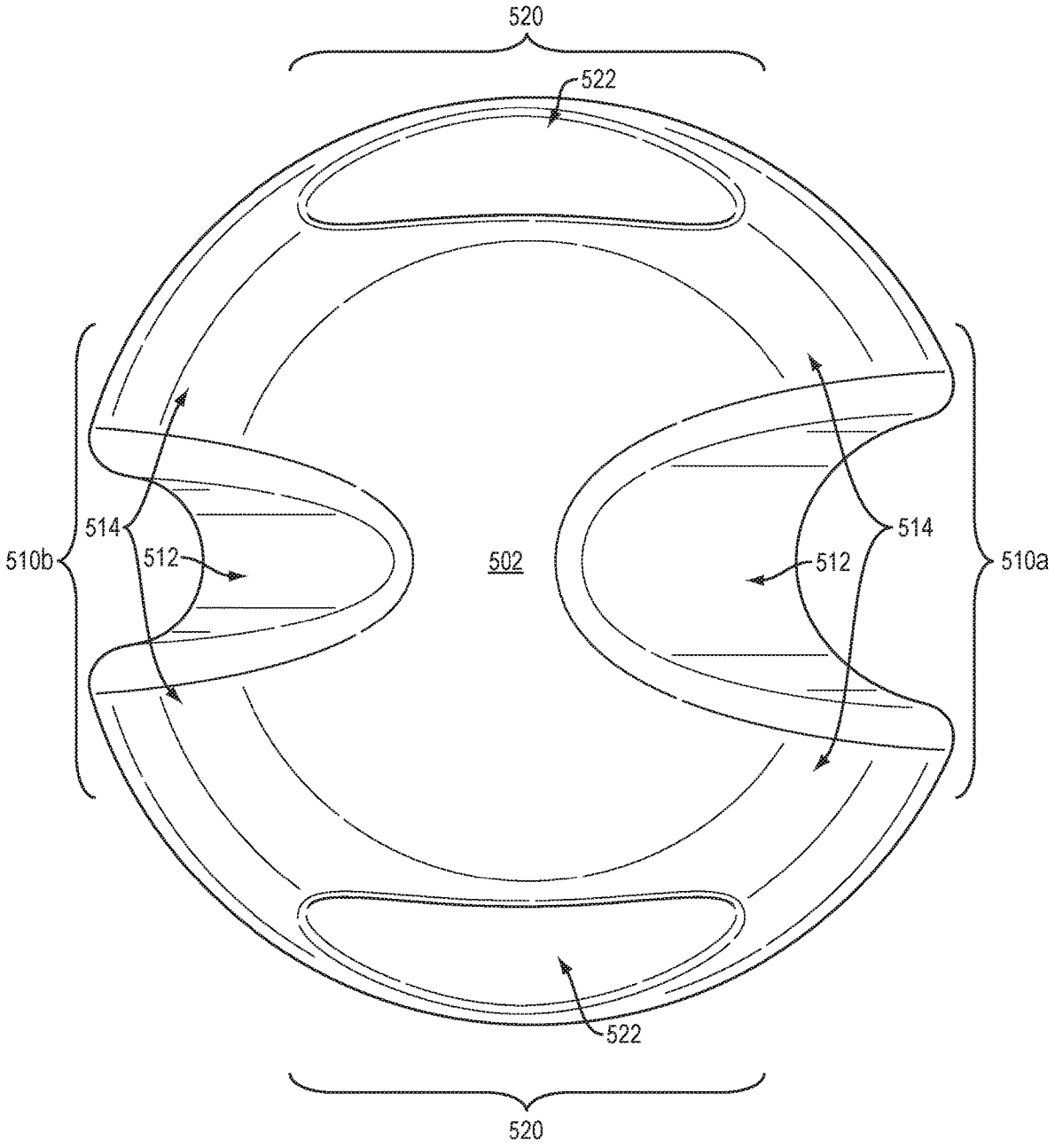
Figure 5E:
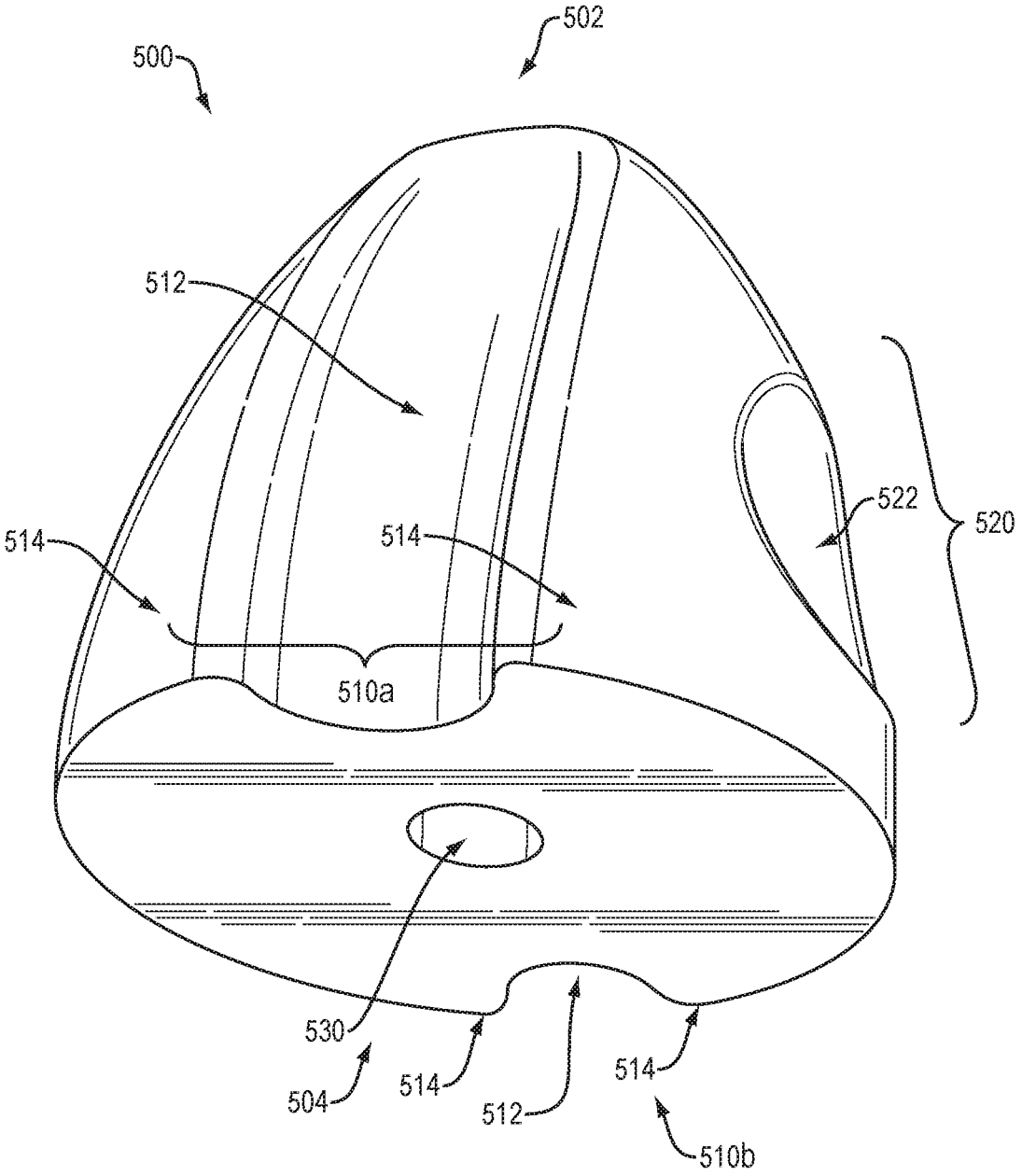

Referring now to FIGS. 4A-B, the anatomically correct pad 100 and protective cup 200 may form a system 300 wherein the pad 100 is configured to mate with the protective cup 200. Thus, as depicted, the recess 112 of the groin-facing portion of the pad 100 is configured to fit over and/or receive a convex geometry of the cup portion 210 of the protective genital cup 200. In the depicted embodiment, the recess 112 is larger (i.e., deeper with respect to the superior-inferior axis of the patient, and wider with respect to the anteroposterior and mediolateral axes of the patient) than the dimensions of the cup portion 210, thereby providing a margin between the pad 100 and cup 200. In this manner, a genital region of the patient may be insulated and distraction forces may be largely isolated from the genital region and distributed across other portions of the hip and/or groin.

In exemplary embodiments, system 300 may be utilized by positioning a patient on a distraction table, with the anatomically correct pad 100 mated relative to a perineal post of a distraction table. The protective cup 200 may then be positioned between the pad 100 and the patient and distraction forces applied. The pad and protective cup would advantageously protect the patient's genital region while redistributing distraction forces along the inner thighs of the patient. Notably, hip arthroscopy may generally utilize either a supine or lateral setup. Both use a perineal post, however the orientation of patient for each setup may be different. The apparatus, systems and methods of the present disclosure may advantageously work with either setup.

With reference now to FIGS. 5A-E, a further exemplary anatomically correct pad 500 is depicted. The pad 500 advantageously defines a plurality of possible groin-facing portions 510*a* and 510*b* which is configured to generally, align with a transverse plane of a patient. Each of the possible groin-facing portions 510*a* and 510*b* includes a respective recess 512 defined medially, e.g., with respect to a midsagittal plane of the patient. In the depicted embodiment, each recess 512 is generally "U" shaped (as defined in a coronal plane of the patient). Moreover, as depicted, each recess 512 is configured to taper toward the middle of the pad 500 (see in particular FIG. 5D). This tapering is consistent with a general conical shape of the pad 500 in the pictured embodiment (note that this tapered or chamfered configuration may advantageously also facilitate instrument mobility and hip access during surgery). Furthermore, this tapering advantageously allows for improved visualization of the genital region during surgery. It is also noted that the recess 512 defined in the first possible groin-facing portions 510*a* is generally larger than the recess 512 defined in the second possible groin-facing portions 510*a*. Thus, it will be appreciated, that a surgeon may select from a plurality of recesses so as to provide optimal fit for a patient's genital region (e.g., based on age, gender, sizing or other factors). Alternatively, in some embodiments a single recess may be reconfigurable/resizable. For example, the recess may be defined by an interchangeable insert component. Furthermore, not-withstanding the specific configuration of the pictured embodiment, other geometries may also be utilized for the recess 512, including, e.g., a spherical cap or elliptical cap shaped geometry or other geometry.

As depicted, the lateral geometry 514 of the possible groin-facing portions 510*a* and 510*b* may also be configured to better conform anatomically with respect to a patient, e.g., with respect to the transition from the groin to a superior portion of the inner thigh. Thus, the lateral geometry 514 of the possible groin-facing portions 510*a* and 510*b* may defines a transition geometry between transverse and sagittal planes of the patient. As characterized by a curvature with respect to a coronal plane of the patient defining a convex surface configured to generally conform with the geometry the lateral groin and/or a superior portion of the inner thigh.

With reference still to FIGS. 5A-E, the pad 500 further includes opposing thigh-facing portions 520 which are configured (e.g. shaped) to align with the inner thighs of a patient. In particular, the opposing thigh-facing portions 520 each define an elongated contact surface 522 configured to distribute forces (e.g., distraction forces) longitudinally (e.g., extending between proximal and distal regions of the thigh). In the depicted embodiment, the elongated contact surfaces 522 are defined by elongated grooves in the sides of the pad which extend parallel to a sagittal plane of the patient. The grooves advantageously provide a concave region that, in use, is configured for conforming with a tubular shape of the patients' inner thighs. Note that, as depicted (see in particular FIGS. 5B and 5C), an arcuate cross-section of the grooves is slightly angled toward a top region 502 of the pad 500 (angled in the ventral direction). This may advantageously facilitate positioning the patient's legs relative to the pad.

The pad 500 further includes a receiving member 530 adapted to mate with a perineal post of a distraction table. As depicted, the receiving member 530 extends through a central or medial portion of the pad 500 between top 502 and bottom 504 regions of the pad and along a sagittal axis. The pad 500 may be used either alone or in combination with a cup such as the example cup 200 described above with respect to FIG. 2.

It is noted that in addition to the primary purpose of protecting a patient's groin area during surgery (such as while distracting the patient's hip), the example pads disclosed herein may also be used postoperatively in order to stabilize a patient's legs. In particular the pad may be detached from the operating table and positioned between the patient's legs adjacent the feet such that the legs are aligned with the flat or contoured areas of the opposing thigh-facing portions. A strap may then be utilized to to bind the patient's legs relative to the pad.

While the apparatus, systems and methods of the present disclosure have been particularly shown and described with reference to example embodiments thereof, it will be understood by those skilled in the art that various changes in form and details may be made therein without departing from the scope of the present disclosure.

We claim:

1. A system for protecting a patient's groin area while distracting the patient's hip, the system comprising: a protective pad comprising a unitary body defining a receiving member adapted to mate with a perineal post of a distraction table, the unitary body having one or more perimeter surfaces extending between a base region and a top region thereof, the one or more perimeter surfaces defining: (i) opposing thigh-facing portions having flat or contoured areas that, in use, are configured to align with the patient's inner thighs, the flat or contoured areas being generally parallel to one another, and, in use, are adapted to be generally parallel to a sagittal plane of the patient and (ii) a groin-facing portion extending between the opposing thigh-facing portions, the groin-facing portion including a first recess that, in use, is configured to fit over a genital region of the patient; and a protective cup including (i) a housing that, in use, is configured to fit over the genital region of the patient, the housing having a perimeter, and (ii) a pair of opposing wings extending from opposite sides of the perimeter of the housing that, in use, are configured to define a saddle-shaped transition extending from the patient's groin to the patient's inner thighs; wherein the first recess of the protective pad is configured to fit over the housing of the protective cup thereby also fitting over the genital region of the patient, wherein:

each wing of the pair of opposing wings defines an arcuate region adapted to transition between the groin and the inner thigh region of the patient, that, in use, is configured to extend a length of the patient's inner thigh from the patient's groin, wherein the pair of opposing wings are a semi-flexible material, such that in use flexing of the pair of opposing wings redistributes forces from the patient's groin along the length of the patient's inner thigh through the pair of opposing wings of the protective cup; and the arcuate region is configured to be conformable relative to an anatomical transition between the patient's groin and the patient's inner thighs.

2. The system of claim 1, wherein the one or more perimeter surfaces further define a second recess on a side of the unitary body opposite from the first recess, the second recess being dimensioned differently than the first recess so as to enable fitting over a smaller or larger genital region than the first recess, during use thereof.

3. The system of claim 2, wherein the first recess is configured for use with a male patient and the second recess is configured for use with a female patient.

4. The system of claim 1, wherein the opposing thigh-facing portions are conformable relative to a shape of the patient's inner thighs.

5. The system of claim 1, wherein the flat or contoured areas are contoured differently than adjacent portions of the one or more perimeter surfaces.

6. The system of claim 1, wherein the flat or contoured areas define concave regions that, in use, are configured for conforming with a tubular shape of the patients' inner thighs.

7. The system of claim 1, wherein the flat or contoured areas define horizontally elongated grooves on opposite sides of the unitary body.

8. The system of claim 1, wherein the flat or contoured areas define planar regions.

9. The system of claim 1, wherein the groin-facing portion is conformable relative to a shape of the patient's groin anatomy.

10. The system of claim 1, wherein the first recess is a vertically elongated groove which, toward the top region of the unitary body and when in use, is adapted to taper away from the genital region so as to allow for visualization of the genital region.

11. The system of claim 1, wherein the one or more perimeter surfaces further define arcuate transition regions between the first recess of the groin-facing portion and the flat or contoured areas of the opposing thigh-facing portions.

12. The system of claim 1, wherein the unitary body tapers from the base region to the top region, so as to allow for visualization of the genital region.

13. The system of claim 1, wherein the receiving member is configured to mate with a peritoneal post via an engaging portion on the peritoneal post.

14. The system of claim 1, further comprising a strap configured for binding the patient's legs or leg relative to the protective pad.

15. The system of claim 1, wherein each wing of the pair of opposing wings defines a concave region that, in use, is configured for conforming with a tubular shape of the patients' inner thighs.

16. The system of claim 1, wherein the housing is more rigid than the pair of opposing wings.

17. The system of claim 1, wherein the pair of opposing wings are made from a semi-flexible polymer.

* * * * *